US006691663B2

(12) United States Patent
Tsukui et al.

(10) Patent No.: US 6,691,663 B2
(45) Date of Patent: Feb. 17, 2004

(54) FOUR-STROKE INTERNAL COMBUSTION ENGINE CYLINDER HEAD

(75) Inventors: Takaaki Tsukui, Saitama (JP); Hiromi Sumi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/162,875

(22) Filed: Jun. 6, 2002

(65) Prior Publication Data

US 2003/0005902 A1 Jan. 9, 2003

(30) Foreign Application Priority Data

Jul. 6, 2001 (JP) ..... 2001-205706

(51) Int. Cl.[7] ..... F02N 3/00
(52) U.S. Cl. ..... 123/188.9; 123/193.5
(58) Field of Search ..... 123/188.9, 193.5

(56) References Cited

U.S. PATENT DOCUMENTS 4,938,187 A 7/1990 Seki
5,357,916 A 10/1994 Matterazzo
5,904,125 A 5/1999 Enright et al.

FOREIGN PATENT DOCUMENTS

JP 11-050852 A 5/1999
JP 2000205038 A 7/2000
JP 2000-205038 A 11/2000

*Primary Examiner*—Noah P. Kamen
(74) *Attorney, Agent, or Firm*—Birch, Stewart, Kolasch & Birch, LLP

(57) ABSTRACT

A cylinder head for an internal combustion engine in which any of a plurality of valve guides for guiding intake and exhaust poppet valves provided with valve lifters can be press-fitted in fitting holes of the cylinder head with a substantially uniform press fit force. At least one valve guide is fitted at a different depth in the cylinder head than others of the guides valves. The intake and exhaust poppet valves have substantially uniform thicknesses in the respective longitudinal directions of the valve guides. An idle fitting hole with an inner diameter greater than an outer diameter of the valve guides is formed above one of the fitting holes which is formed deeper in the cylinder head than the other fitting holes, the idle fitting hole extending upward to a lower side of a valve spring.

22 Claims, 12 Drawing Sheets

FRONT OF VEHICLE BODY

FOUR-STROKE INTERNAL COMBUSTION ENGINE CYLINDER HEAD

CROSS-REFERENCE TO RELATED APPLICATIONS

The present application claims priority under 35 USC 119 to Japanese Patent Application No. 2001-205706 filed on Jul. 6, 2001 the entire contents thereof is hereby incorporated by reference.

BACKGROUND OF THE INVENTION

1. Field of the Invention

The present invention relates to a cylinder head of an overhead camshaft (OHC) four-stoke engine with valve lifters in which at least one of a plurality of valve guides for guiding intake and exhaust poppet valves in an opened or closed direction can have a slide fit of a different depth as compared to the other valve guides. More particularly, the present invention relates to a cylinder head in which a valve pause mechanism is provided to an intake poppet valve or an exhaust poppet valve that is fitted into a shallow valve guide in the depth of a fitted fitting hole.

2. Description of Background Art

As shown in FIG. 13, in an OHC four-stroke internal combustion engine provided with a valve lifter 00, the lower ends $X_1$, $X_2$ of valve lifter springs 03, 04 always press intake and exhaust poppet valves 01, 02 in a closed direction. The valve lifter springs 03, 04 and are in different positions of the valve lifter, depending on whether or not the valve lifter is provided with a valve pause mechanism 05. The valve lifter spring 03 associated with the intake or exhaust poppet valve 01 is provided with the valve pause mechanism 05 that is positioned lower by the height of the valve pause mechanism 05 attached to the valve lifter 00 of the intake or exhaust poppet valve 01. Thus, valve guide 06 permits the intake or exhaust poppet valve 01 to slide a shorter distance as compared with a valve guide 07 on the side provided without a valve pause mechanism 05. For example, refer to Japanese Published Unexamined Patent Application No. 2000-205038.

Therefore, the longer valve guide 07 for guiding the intake or exhaust poppet valve 02 without a valve pause mechanism 05 must be press-fitted deeper into a fitting hole 09. Thus, the press fitting resistance for valve guide 07 without a valve pause mechanism is remarkably larger as compared with the press fitting resistance for the valve guide 06 of the intake or exhaust poppet valve 01 that is provided with the valve pause mechanism 05. As a result, the setting of the press fit time of each valve guide 06, 07 is different, and the management of the manufacturing process is complex.

SUMMARY AND OBJECTS OF THE INVENTION

The invention relates to an improvement of a cylinder head of a four-stroke internal combustion engine in which such a problem is solved. The present invention is based upon a cylinder head of a four-stroke internal combustion engine in which each of a plurality of valve guides for guiding and supporting intake and exhaust poppet valves in an opened or closed direction so that they can slide. The poppet valves have substantially a uniform thickness in the longitudinal direction of the valve guide. A depth of at least one of the plurality of valve guides fitted in the cylinder head is different from the depth of the other valve guides that are fitted in the cylinder head. An idle fitting hole having a depth that is acquired by subtracting the depth that is substantially equal to the depth of the shallower fitted hole from the depth of the deeper fitted hole is formed from the end face of a fitted hole on the side of a valve spring toward an inlet port or an exhaust port in the cylinder head. The inner diameter of the idle fitting hole is larger than the inner diameter of the deeper fitted hole.

The present invention is configured as described above with all the valve guides press-fitted at a uniform press fit depth in the cylinder head independent of the length of a specific valve guide, even if one specific valve guide out of the plurality of valve guides is longer than the other valve guides.

Therefore, the setting of the press fit time is simplified, and the press fitting force required to press-fit each of the valve guides is substantially equal. The control required to press-fit is facilitated, the quality of press fitting is stabilized, and the productivity is enhanced.

Also, according to the present invention, a long valve guide for guiding an intake or exhaust poppet valve not having a valve pause mechanism can be press-fitted with the same force. Therefore, the same time is required forpress fitting either a long or a short valve guide.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
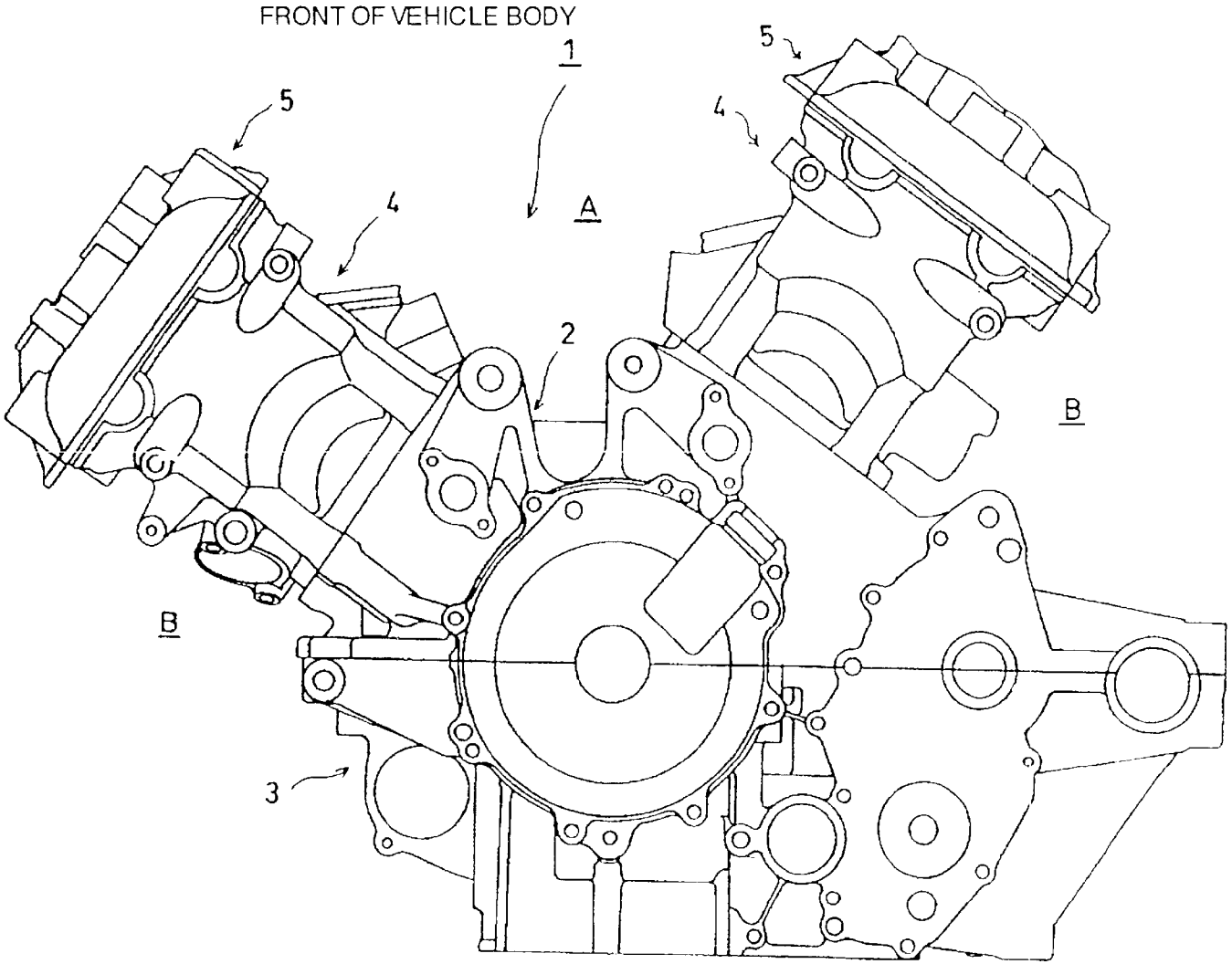
FIG. 1 is a schematic side view showing a four-stroke internal combustion engine with a valve pause mechanism according to the invention.

One embodiment of the invention shown in FIGS. 1 to 12 will be described below. An OHC four-stroke internal combustion engine 1 mounted on a motorcycle (not shown) is a fore and after V-type internal combustion engine. The engine has a crankshaft (not shown) directed in a direction of the body width, a cylinder on the front side of a vehicle body, and a cylinder on the rear side of the vehicle body , with a right angle included between the two cylinders as shown in FIG. 1. The body of the OHC four-stroke internal combustion engine 1 includes a cylinder block 2, a crankcase 3 integrated with the cylinder block 2 on the lower surface of the cylinder block 2, a pair of two cylinder heads 4 integrated with the respective head end of a cylinder bank on the front side of the vehicle body and a cylinder bank on the rear side of the vehicle body in the cylinder block 2, and a pair of two head covers 5 that, respectively, cover the heads of the cylinder heads 4.

Figure 2:
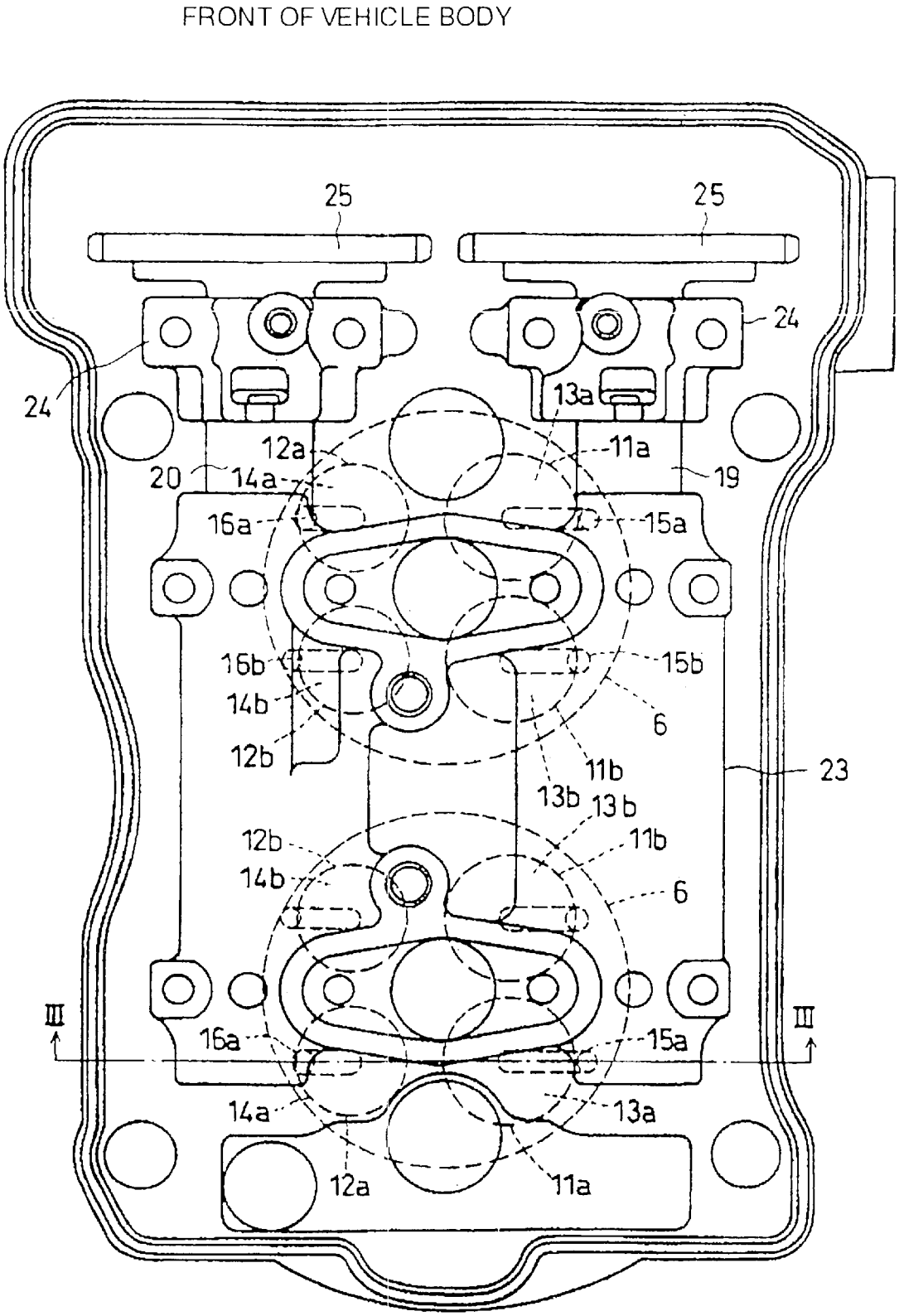
FIG. 2 is a top view showing a front cylinder head from which a front head cover is detached.
Figure 3:
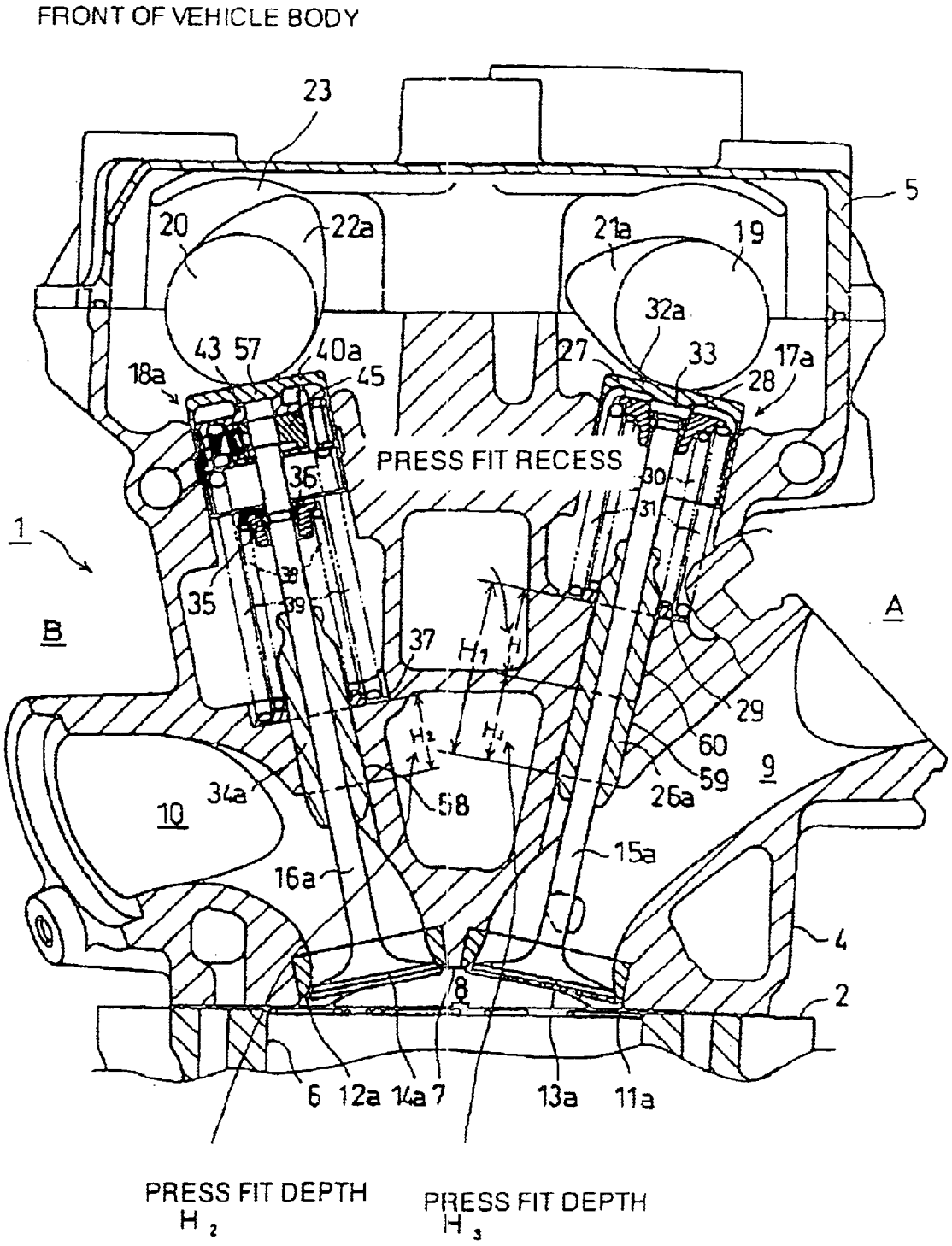
FIG. 3 is a longitudinal side view viewed along a line III—III in FIG. 2.
Figure 4:
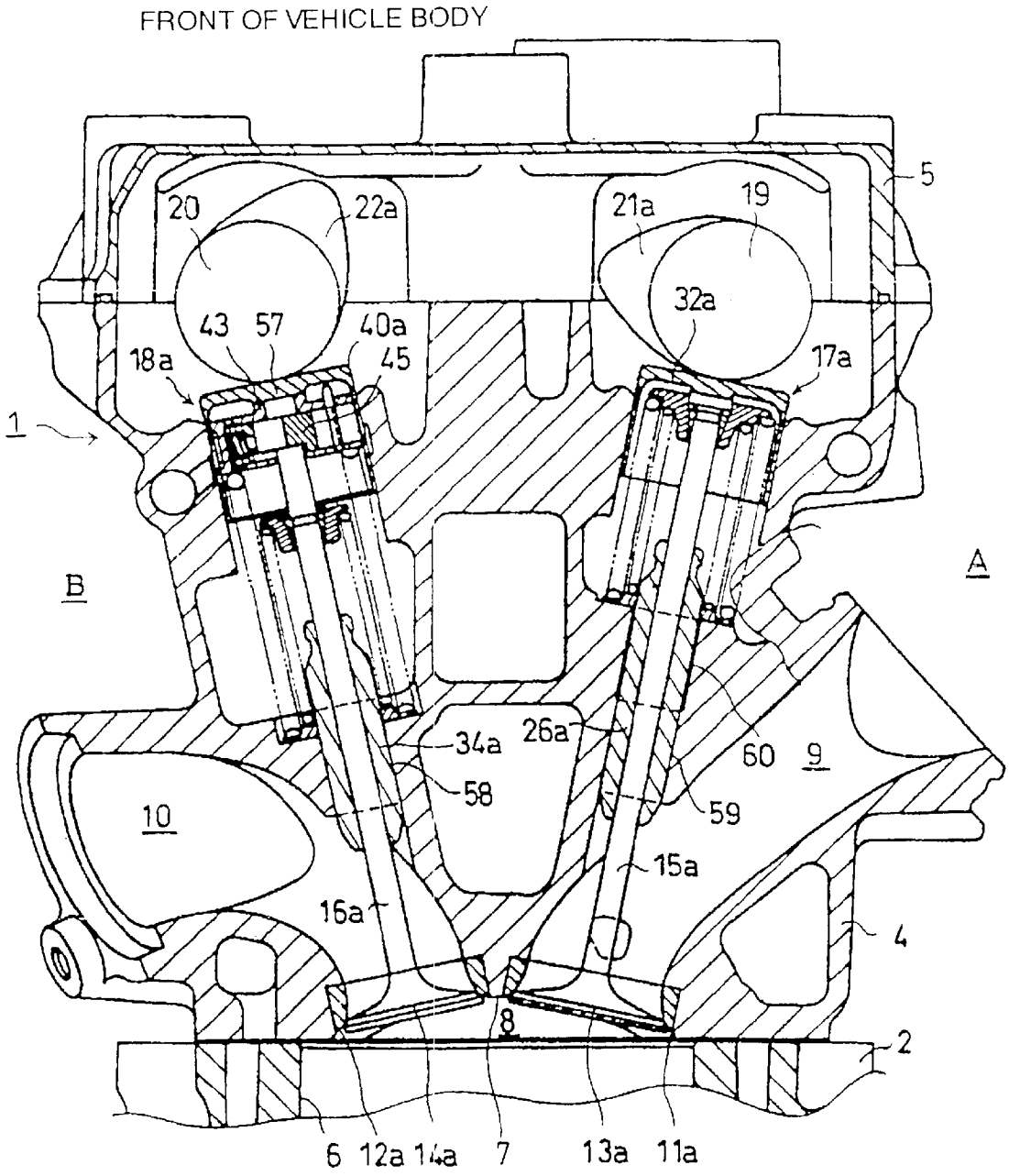
FIG. 4 is a longitudinal side view showing a state in which the pause of a valve is released in FIG. 3.
Figure 5:
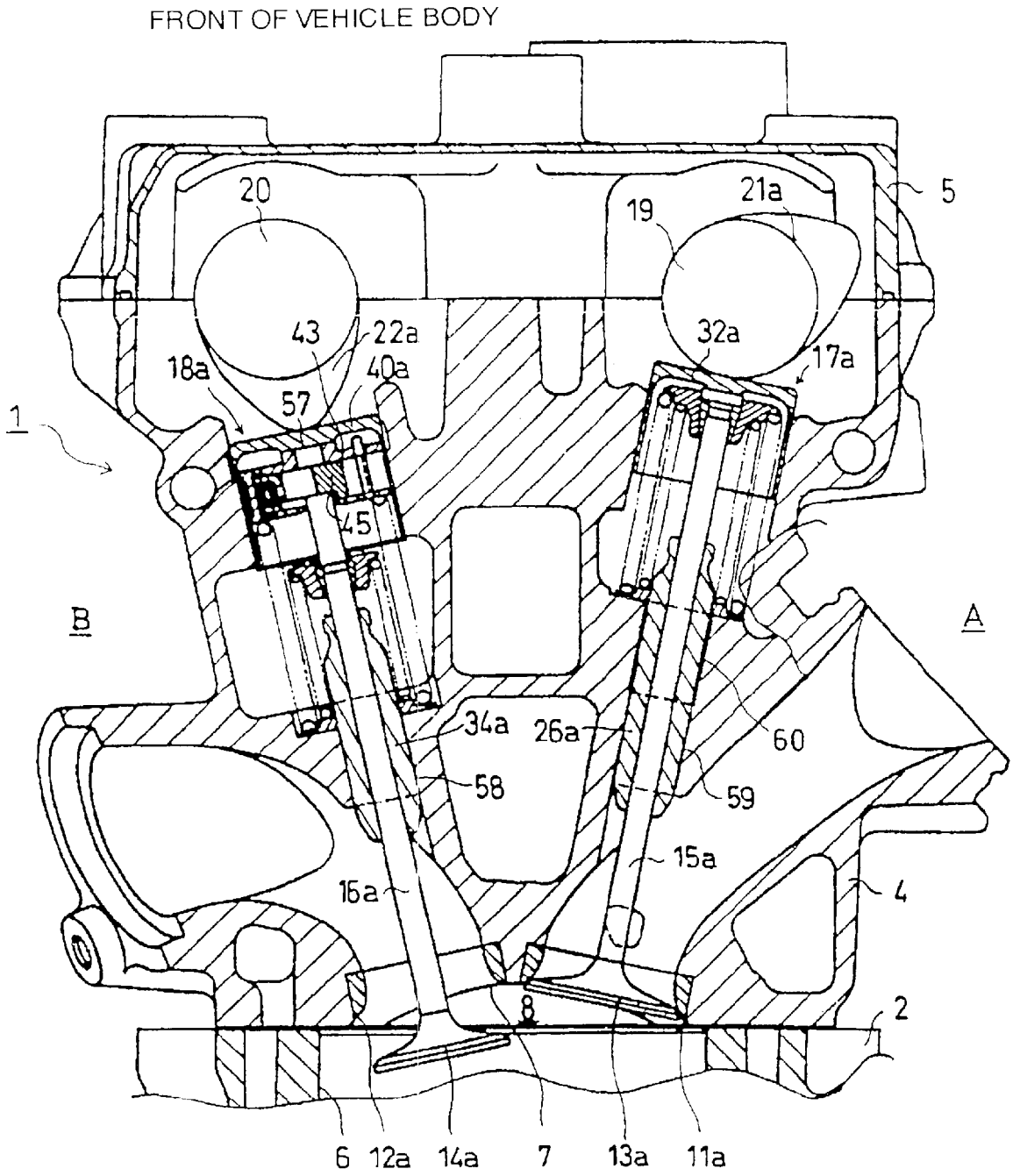
FIG. 5 is a longitudinal side view showing a state in which the pause of the valve is released and an exhaust valve is opened by a cam in FIG. 3.

The cylinder blocks 2 are installed on the front side of the vehicle body and on the rear side of the vehicle body. Two cylinder holes 6 are arranged in each of the cylinder blocks in the direction of the body width as shown in FIG. 2 (only the cylinder block on the front side of the vehicle body out of the cylinder blocks on the front side and the rear side is shown), thus forming the four-cylinder OHC four-stroke internal combustion engine 1. A pent roof type concave portion 7 is respectively formed in a location corresponding to the cylinder hole 6 on the lower surface of each cylinder head 4 located on the front side and on the rear side of the vehicle body as shown in FIGS. 3 to 5. A combustion chamber 8 is formed by a piston (not shown) fitted into the cylinder hole 6, the cylinder hole 6 and the concave portion 7.

Further, in each cylinder bank of the V-type four-cylinder OHC four-stroke internal combustion engine 1, an intake system (not shown) including a carburetor and an intake chamber is arranged in space A. As can be seen in FIG. 1, space A is a space in the right angle formed between the cylinder bank on the front side of the vehicle body and the cylinder bank on the rear side of the vehicle body. An exhaust pipe, not shown, is connected outside each cylinder bank on the front side and on the rear side of the vehicle body (the outside B of the fore and after V-type space A).

Figure 6:
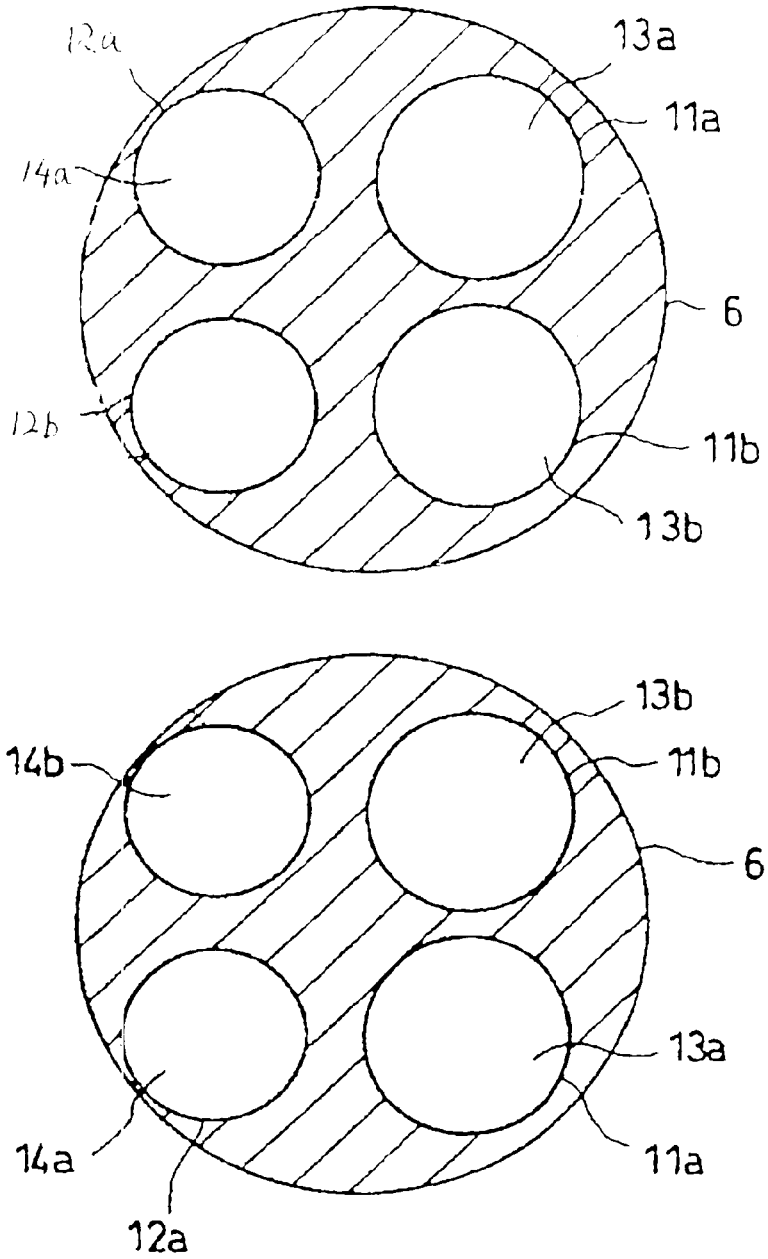
FIG. 6 is an explanatory drawing showing a state in which cylinder holes and intake and exhaust poppet valves are arranged.

Further, as shown in FIGS. 3 to 5, on the rear side of the vehicle body of the cylinder head 4 on the front side of the vehicle body, one intake passage is formed on the upstream side connected to the intake system. The intake system is branched into two intake passages on the downstream side of the intake and an inlet port 9 open to the combustion chamber 8 in two locations. On the front side of the vehicle body of the cylinder head 4 on the front side of the vehicle body, two exhaust passages on the upstream side that open to the combustion chamber 8 in two locations are integrated in one exhaust passage on the downstream side of the exhaust. An exhaust port 10 is connected to the exhaust pipe, not shown. As shown in FIGS. 2 and 6, intake poppet valves 13*a* and 13*b* and exhaust poppet valves 14*a* and 14*b* are provided on the cylinder head to respectively seal two inlet openings 11*a* and 11*b* and two exhaust openings 12*a* and 12*b* so that the valves can be opened or closed.

An inlet port and an exhaust port that are reverse in fore and after positions to the inlet port 9 and the exhaust port 10 in the cylinder head 4 on the front side of the vehicle body are also formed in the cylinder head 4 on the rear side of the vehicle body. That is, on the front side of the vehicle body of the cylinder head 4 on the rear side of the vehicle body, the inlet port (not shown) is formed in the same shape as that of the inlet port 9 on the rear side of the vehicle body of the cylinder head 4 on the front side of the vehicle body and on the rear side of the vehicle body of the cylinder head 4 on the rear side of the vehicle body. The exhaust port (not shown) is formed in the same shape as that of the exhaust port 10 on the front side of the vehicle body of the cylinder head 4 on the front side of the vehicle body.

Furthermore, as shown in FIGS. 2 and 6, the intake poppet valve 13*a*, to which a valve lifter 17 without a valve pause mechanism shown in FIGS. 3 to 5 attached, is provided to the inlet opening 11*a* located on the outside of the vehicle body in each cylinder hole 6. The exhaust poppet valve 14*a*, the opening or the closing of which can be paused and to which a valve lifter 18 with the valve pause mechanism shown in FIGS. 3 to 5 is attached, is provided to the exhaust opening 12*a* located on the outside of the vehicle body in each cylinder hole 6.

The intake poppet valve 13*b*, to which the valve lifter 18 with the valve pause mechanism that is attached, is provided to the inlet opening 11*b* located on the inside of the vehicle body in each cylinder hole 6 reversely to the inlet opening 11*a* on the outside of the vehicle body. The valve lifter 17 without the valve pause mechanism is attached to the exhaust opening 12*b* located on the inside of the vehicle body in each cylinder hole 6 reversely to the exhaust opening 12*a* on the outside of the vehicle body (not shown in the longitudinal sectional view).

Following is a description of the intake poppet valve 13*a* that is provided to the inlet opening 11*a* on the outside of the vehicle body in the cylinder head 4 on the front side of the vehicle body and provided with the valve lifter 17 without the valve pause mechanism. Also described below is the exhaust poppet valve 14*a* provided to the exhaust opening 12*a* and provided with the valve lifter 18 with the valve pause mechanism.

An inlet camshaft 19 is arranged over an extension of a stem 15*a* of the intake poppet valve 13*a*. An exhaust camshaft 20 is arranged over an extension of a stem 16*a* of the exhaust poppet valve 14*a*. The inlet camshaft 19 and the exhaust camshaft 20 are attached to the cylinder head 4, respectively, by a camshaft holder 23 located in the center in the direction of the body width and a camshaft holder 24 located on the right side in the direction of the body width so that the respective camshafts can be rotated as shown in FIG. 2. An inlet cam 21*a* of the inlet camshaft 19 and an exhaust cam 22*a* of the exhaust camshaft 20 are provided with every cylinder hole 6 touched to each top face of the valve lifter 17*a* without the valve pause mechanism of the intake poppet valve 13*a* and the valve lifter 18*a* with the valve pause mechanism of the exhaust poppet valve 14*a*. A driven sprocket 25 is respectively integrated with the inlet camshaft 19 and the exhaust camshaft 20 at the right end of the vehicle body. A continuous chain (not shown) is positioned between a drive sprocket (not shown) integrated with a crankshaft not shown and the driven sprocket 25. When the OHC four-stroke internal combustion engine 1 is operated, an inlet cam 21 and an exhaust cam 22 rotate at a speed equivalent to one-half of the rotational speed of the crankshaft and in the same direction.

As shown in FIGS. 3 to 5, each contact surface of the cylinder head 4 and the camshaft holder 23 or 24 is located in a plane tying the center of the inlet camshaft 19 and the center of the exhaust camshaft 20. Each contact surface of the cylinder head 4 and the camshaft holder 23 or 24 is made to be parallel to each contact surface of the cylinder block 2 and the cylinder head 4. Therefore, the distance from the top wall 32 of the valve lifter 17 without the valve pause mechanism to the inlet opening 11 and distance from the top wall 40 of the valve lifter 18 with the valve pause mechanism to the exhaust opening 12 are made substantially equal.

A retainer 27 is integrally fitted to the top of the stem 15*a* via a cotter 28 adjacently under the lower surface of the top wall 32*a* of the valve lifter 17*a* without the valve pause mechanism. Likewise, a retainer 35 is integrated fitted via a cotter 36 further under the valve pause mechanism 41 under the top wall 40 of the valve lifter 18*a* with the valve pause mechanism. The length of valve lifter springs 30 and 31 for pressing the intake poppet valve 13 and the valve lifter 17*a* without the valve pause mechanism upward, and the length of valve lifter springs 38 and 39 for pressing the exhaust poppet valve 14 upward and a valve lifter spring 39 for pressing the valve lifter 18*a* with the valve pause mechanism upward, are substantially identical in length. This provides spring loads which are substantially identical.

Therefore, as shown in FIG. 3, a valve guide cylinder 26*a* that guides and supports the stem 15*a* of the intake poppet valve 13*a* is longer than a valve guide cylinder 34*a* that guides and supports the stem 16*a* of the exhaust poppet valve 14*a*. In addition, a valve spring retainer 29 is provided for supporting each lower end of the valve lifter springs 30 and 31 of the intake poppet valve 13*a*, and a valve spring retainer 37 is provided for supporting each lower end of the valve lifter springs 38 and 39 of the exhaust poppet valve 14*a*. As a result, the depth $H_1$ into which the valve guide cylinder 26*a* is fitted into the cylinder head 4 is deeper than the depth $H_2$ into which the valve guide cylinder 34*a* is fitted into the cylinder head 4.

The cylinder head 4 is cast so that a fitting hole 58 having a smaller inner diameter than the outside diameter of the valve guide cylinder 34*a* is formed in a portion of the cylinder head 34 into which the valve guide cylinder 34*a* is fitted. A lower fitting hole 59 having a inner smaller diameter than the outside diameter of the valve guide cylinder 26*a* and having a depth $H_3$, and an upper idle fitting hole 60 having a larger diameter than the outside diameter of the valve guide cylinder 26*a* are formed in a portion of the cylinder head into which the valve guide cylinder 26*a* is fitted . Depth $H_3$ of the lower fitting hole 59 is substantially the same as depth $H_2$ of the the fitting hole 58. The cutting work is reduced with respect to the respective outside diameters of the valve guide cylinders 34*a* and 26*a* by an amount of press fitting that is applied to form the whole fitting hole 58 and the lower fitting hole 59 in the cylinder head 4. Above the fitting hole 59, if necessary, the cutting work is applied to an extent that the peripheral surface of the valve guide cylinder 26*a* doesnot touch the upper idle fitting hole 60 at all.

As can be seen in FIG. 3, the depth of the fitting hole 58 of the valve guide cylinder 34*a* is set to $H_2$. The depth of the fitting hole 59 into which the valve guide cylinder 26*a* is fitted is set to $H_1$, and the depth of the idle fitting hole 60 is set to H ($=H_1-H_3$) acquired by subtracting $H_3$ from the depth $H_1$ of the fitting hole 59. Depth $H_2$ is substantially equal to depth $H_3$.

The inside diameter of the idle fitting hole 60 is adjusted in a range from a minimum value of a diameter in which no interference with the valve guide 26*a* caused by the eccentricity of the fitting hole 59 occurs to a maximum value of the diameter in which an area where no bucking buckling occurs in the valve spring retainer 29 can be secured. Therefore, so long as the above-mentioned condition is met, the idle fitting hole 60 can also be formed by casting out instead of by cutting work.

Also, the valve guide cylinder 34*a* and the valve guide cylinder 26*a* are press-fitted into the fitting hole 58 and the lower fitting hole 59, respectively, with press-in forces which are substantially equal.

Further, the valve spring retainers 29 and 37 are fitted to the respective upper exposed parts of the valve guide cylinder 26*a* and the valve guide cylinder 34*a*. The two inside and outside valve lifter springs 30 and 31 are fitted in parallel between the retainer 27 and the valve spring retainer 29. Similarly, the two inside and outside valve lifter springs 38, 39 are fitted in parallel between the retainer 35 or the valve pause mechanism 41 and the valve spring retainer 37. The intake poppet valve 13 and the exhaust poppet valve 14 are pressed in a direction in which the inlet opening 11*a* of the inlet port 9 and the exhaust opening 12*a* of the exhaust port 10 are sealed by the spring of the valve lifter springs 30, 31 and the valve lifter springs 38, 39. The top wall 32*a* of the valve lifter 17*a* without the valve pause mechanism and the top wall 40*a* of the valve lifter 18*a* with the valve pause mechanism are pressed in a direction in which the valve lifters respectively touch the inlet cam 21*a* and the exhaust cam 22*a*.

A shim 33 is fitted between the top wall 32*a* of the valve lifter 17*a* without the valve pause mechanism and the top end of the stem 15*a*. A thicker part 57 slightly thicker than shim 33 is formed in the center of the top wall 40*a* of the valve lifter 18*a* with the valve pause mechanism. The thicker shim part 57 is formed in various thickness and a few types of valve lifters 18*a* with the valve pause mechanism are prepared.

Next, the valve pause mechanism 41 in the valve lifter 18 with the valve pause mechanism will be described.

Figure 7:
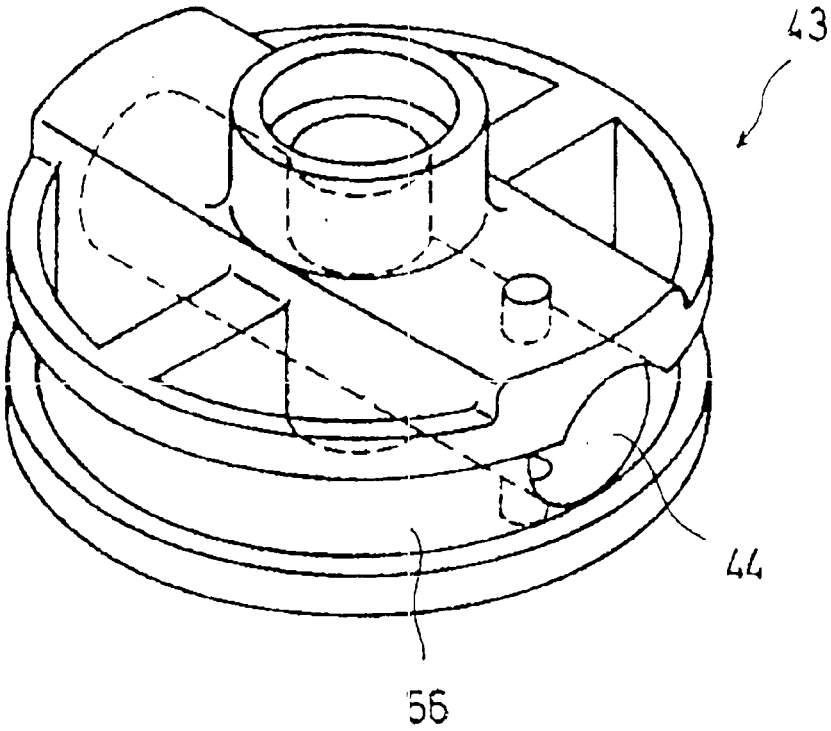
FIG. 7 is a perspective view showing a slide pin holder.
Figure 8:
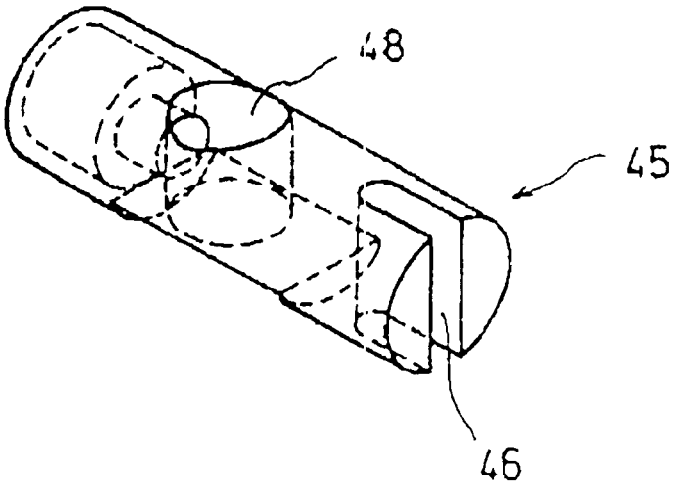
FIG. 8 is a perspective view showing a slide pin.
Figure 9:
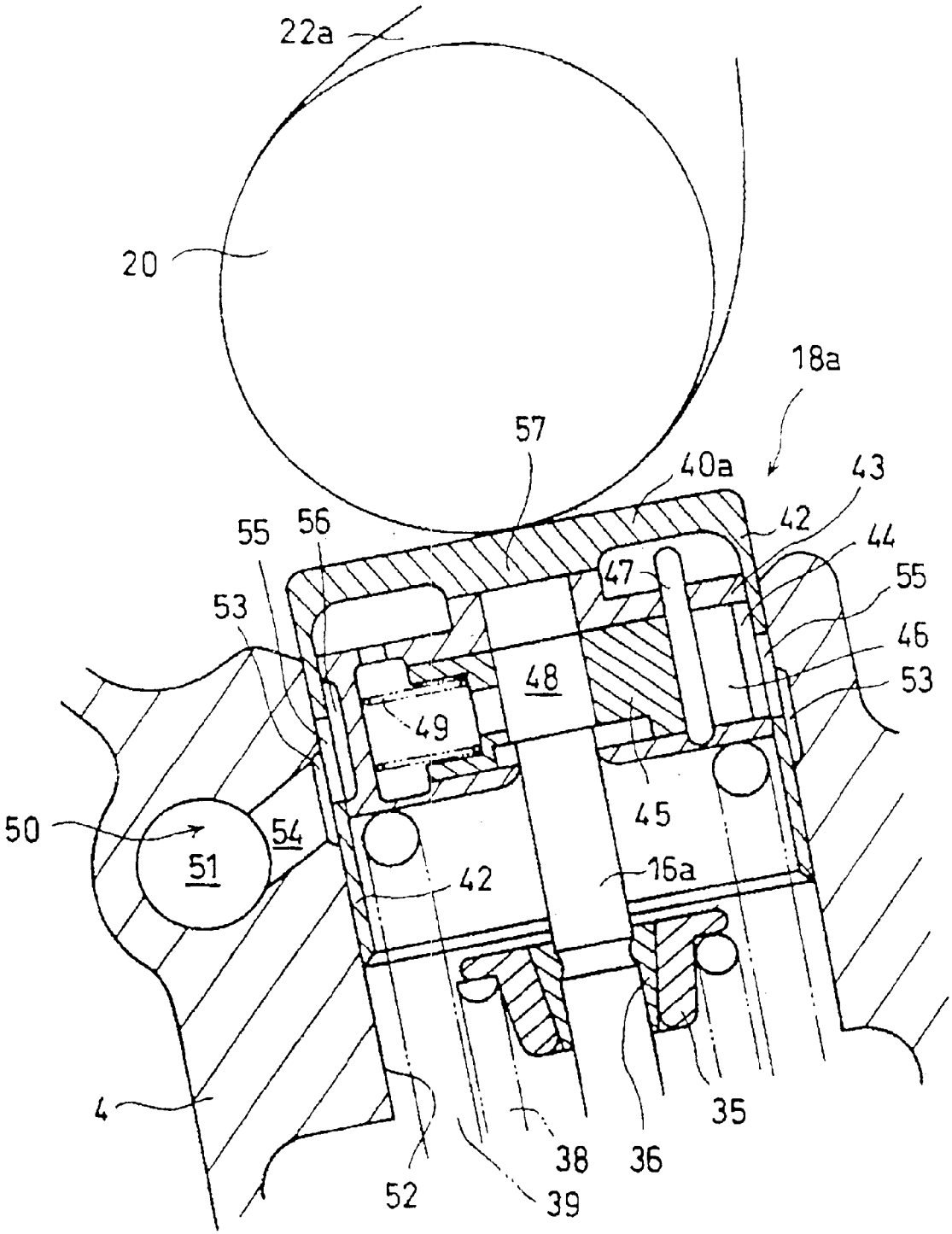
FIG. 9 is a longitudinal side view showing an enlarged main part showing a valve pause state of a valve lifter with a valve pause mechanism.
Figure 10:
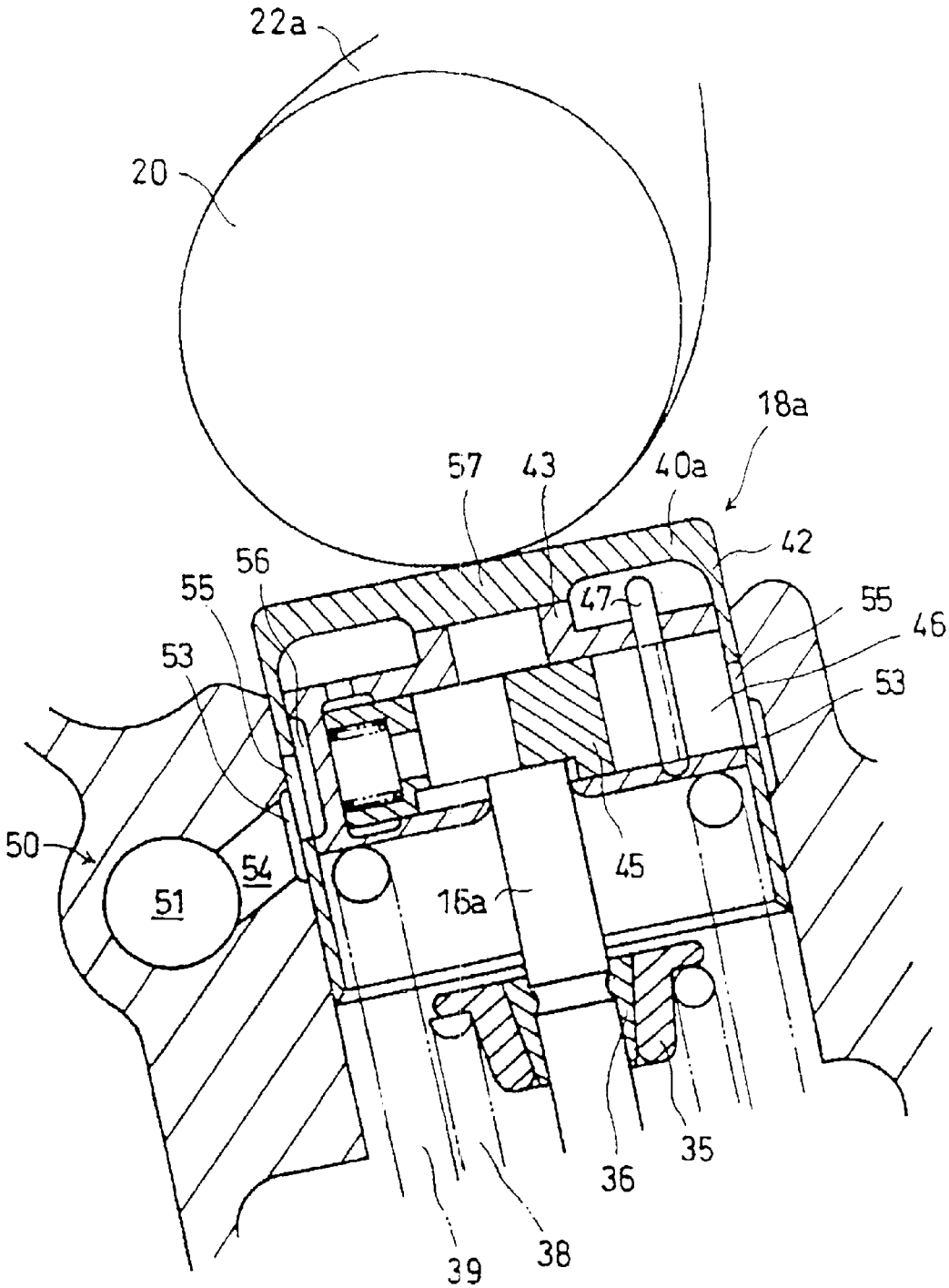
FIG. 10 is a longitudinal side view showing an enlarged main part showing a valve pause released state of a valve lifter with a valve pause mechanism.
Figure 11:
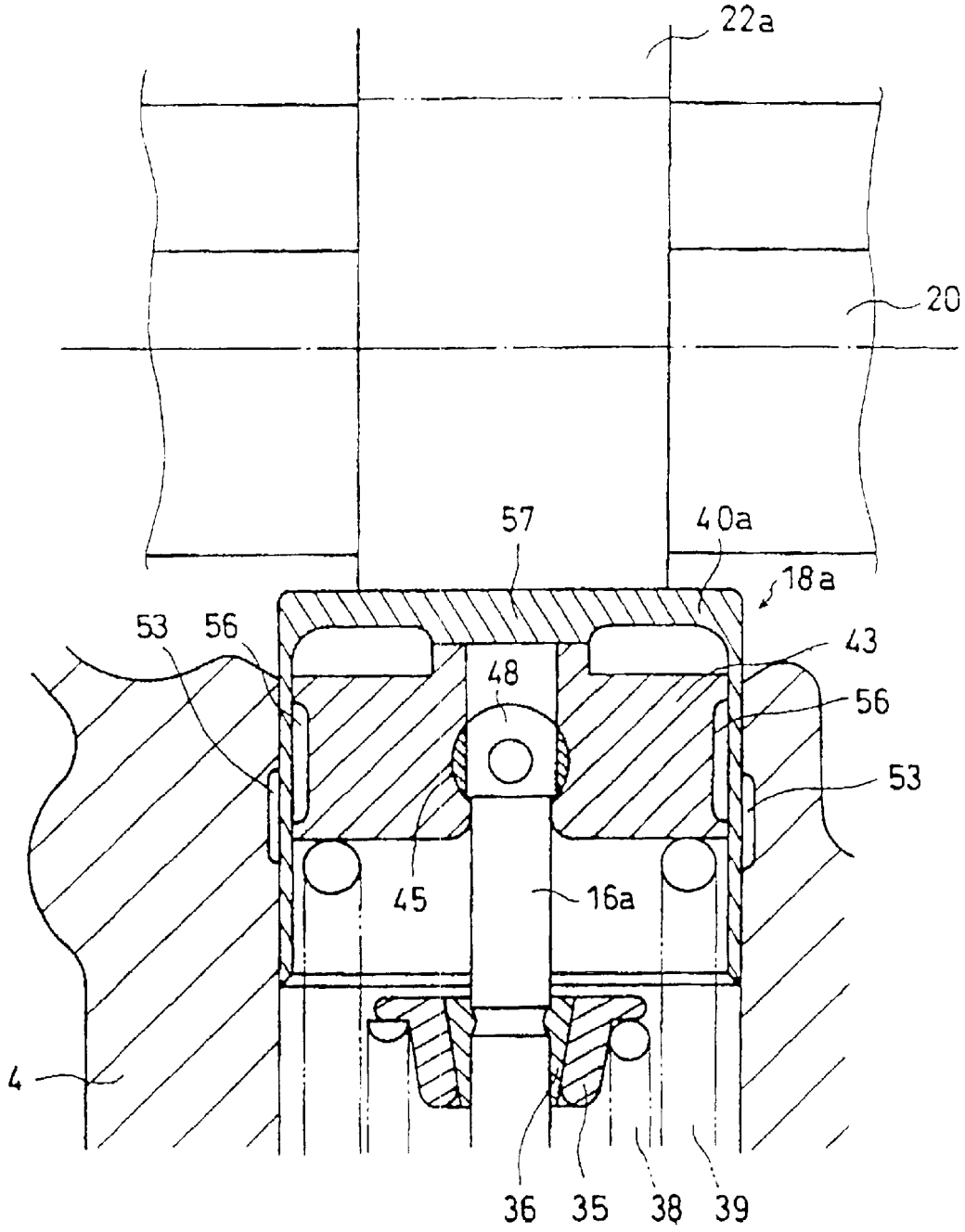
FIG. 11 is a sectional view viewed along a line XI—XI in FIG. 9.
Figure 12:
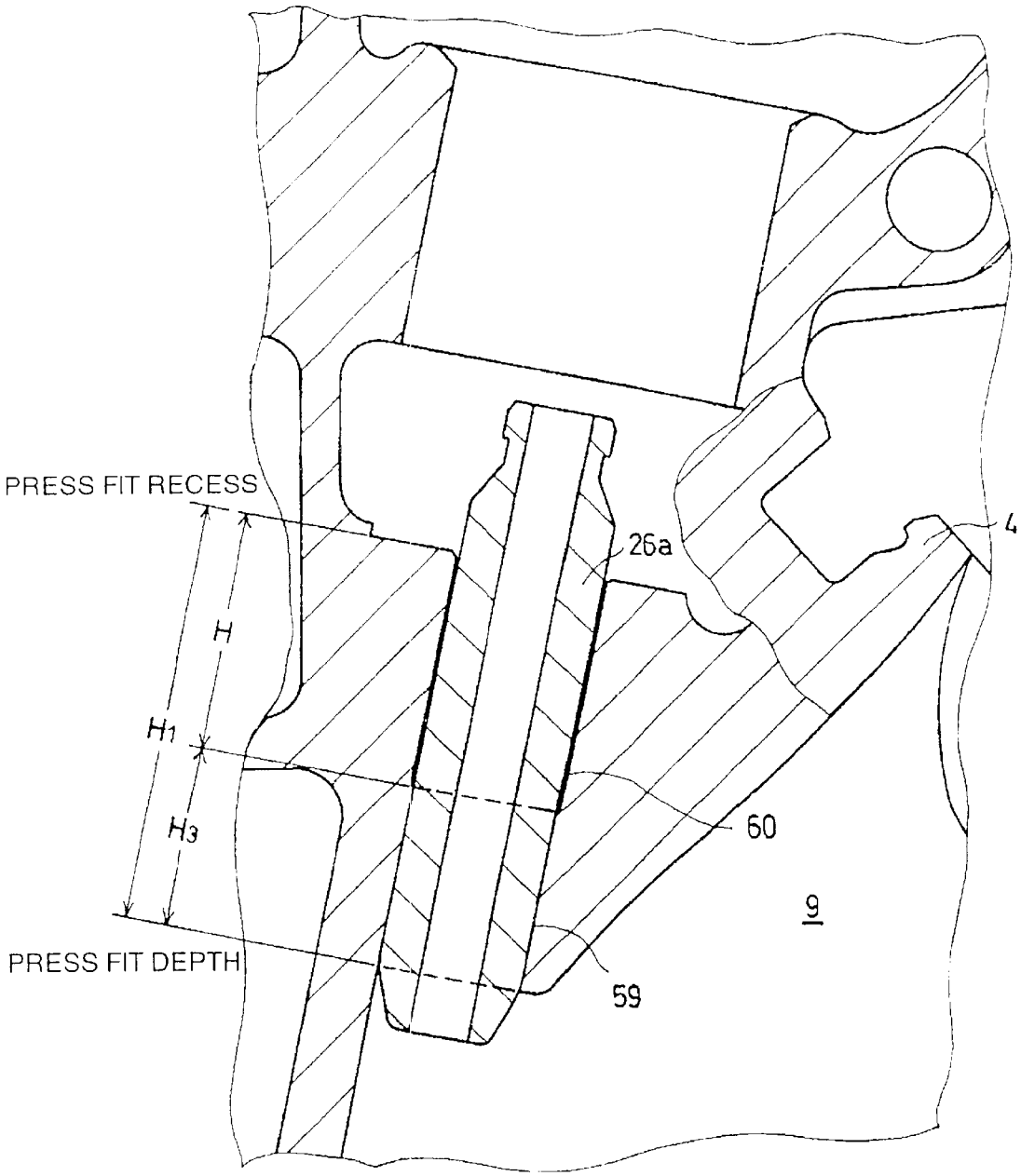
FIG. 12 is a longitudinal side view in which the main part shown in FIG. 3 is enlarged.
Figure 13:
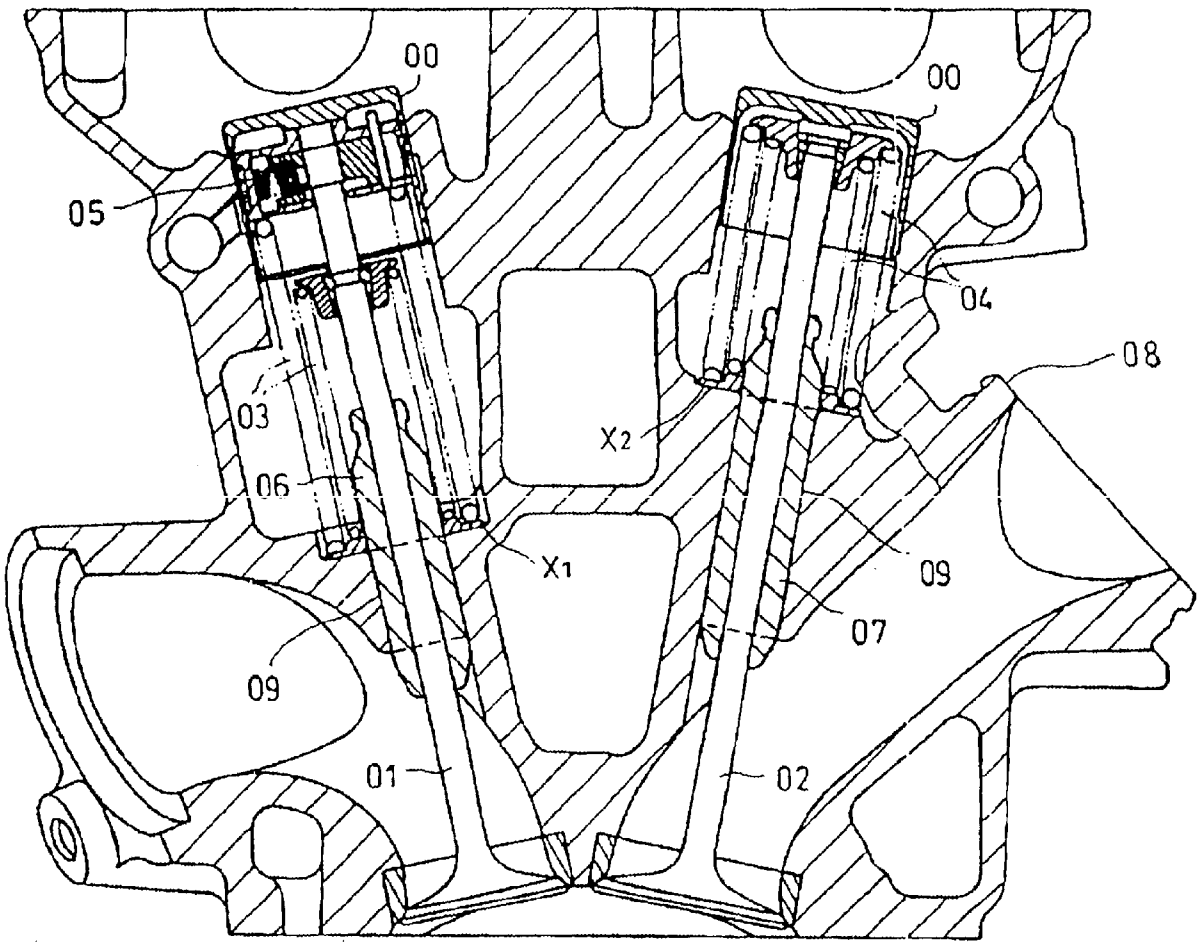
FIG. 13 PRIOR ART
FIG. 13 is a longitudinal sectional view showing the main part of a cylinder head of a conventional type four-stroke internal combustion engine with a valve pause mechanism.

As shown in FIGS. 9 and 10, the valve pause mechanism 41 is formed by a slide pin holder 43 shown in FIG. 7 fitted to a cylindrical peripheral wall 42 of the valve lifter 18*a* with the valve pause mechanism. The slide pin holder can be moved in a direction (a vertical direction) in which the valve lifter 18*a* with the valve pause mechanism is slidably mounted. A slide pin 45 shown in FIG. 8 is fitted into a pin hole 44 of the slide pin holder 43 so that the slide pin can slide to fit the valve pause mechanism to the stem 16*a* of the exhaust poppet valve 14*a* so that the slide pin can be detached. A guide pin 47 pierces the slide pin holder 43 and is fitted into a guide groove 46 formed at one end of the slide pin 45. A pin spring 49 is fitted to the other end of the slide pin 45 and to the bottom of the pin hole 44 of the slide pin holder 43 and presses the bottom of the guide groove 46 of the slide pin 45 in a direction in which the bottom touches the guide pin 47. A hydraulic drive unit 50 presses the slide pin 45 towards the pin spring 49 against the spring in a stem through hole 48.

FIG. 9 shows a situation where no oil pressure is supplied to an oil pressure passage 51 on one end side of the pin hole 44 by the hydraulic drive unit 50 and the bottom of the guide groove 46 of the slide pin 45 touches the guide pin 47 by the pin spring 49, and the stem through hole 48 is formed in the slide pin 45 in a direction in which the stem 16*a* of the exhaust poppet valve 14*a* extends. In this situation, the stem 16*a* of the exhaust poppet valve 14*a* can freely slide in the stem through hole 48 of the slide pin 45.

In the hydraulic drive unit 50, as shown in FIGS. 9 and 10, the pressure oil passage 51 connected to a discharge port of a hydraulic pump (not shown) via a control valve (not shown) that is formed in the cylinder head 4. A peripheral concave groove 53 is formed in a lifter guide hole 52 of the valve lifter 18 with the valve pause mechanism provided relative to the cylinder head 4. The pressure oil passage 51 and the peripheral concave groove 53 communicate via a connecting hole 54.

Further, a side hole 55 that communicates with the peripheral concave groove 53 of the lifter guide hole 52 is formed in the cylindrical peripheral wall 42 of the valve lifter 18 with the valve pause mechanism, even if the valve lifter 18*a* with the valve pause mechanism is located in any location when the valve lifter 18*a* with the valve pause mechanism is vertically moved by the exhaust cam 22*a*. As shown in FIG. 7, the peripheral concave groove 56 that communicates with the side hole 55 is formed on the peripheral surface of the slide pin holder 43. The peripheral concave groove 56 communicates with an opening of the pin hole 44. When oil pressure is supplied to the oil pressure passage 51, oil pressure is supplied to the opening of the pin hole 44 from the oil pressure passage 51 via the connecting hole 54, the peripheral concave groove 53, the side hole 55 and the peripheral concave groove 56. The slide pin 45 then moves toward the pin spring 49 against the spring force of the pin spring 49 with the pressure of the pressure oil (see FIGS. 4, 5 and 10). The stem 16*a* of the exhaust poppet valve 14*a* is fitted to the slide pin 45. The valve lifter 18*b* with the valve pause mechanism is provided relative to the inlet port 11*b* located on the inside of the vehicle body reversely to the inlet port 11*a* on the outside of the vehicle body. The valve lifter 17*b* without the valve pause mechanism is provided relative to the exhaust port 12*b* located on the inside of the vehicle body.

In the embodiment shown in FIGS. 1 to 12, as described above, the fitting hole 59 into which the longer valve guide cylinder 26*a* is press-fitted and the fitting hole 58 into which the shorter valve guide cylinder 34*a* is press-fitted are substantially equal in press fit thickness and press fit depth. Therefore, the valve guide cylinders 26*a* and 34*a* can be respectively press-fitted into the fitting holes 59 and 58 of the cylinder head 4 with the same press fitting force and press fitting time. Therefore, the press fitting work and the control of the valve guide cylinders 26*a* and 34*a* are greatly simplified. Productivity is enhanced, and the press fit quality is stabilized.

A similar effect is also produced with regard to the press fitting of a valve guide cylinder 26*b* for guiding and supporting a stem 15*b* of another intake poppet valve 13*b*, and the press fitting of a valve guide cylinder 34*b* for guiding and supporting a stem 16*b* of another exhaust poppet valve 14*b*.

In a state wherein the OHC four-stroke internal combustion engine 1 is operated at a low speed or at a low load and no oil pressure is supplied to the oil pressure passage 51, the slide pin 45 is pressed and moved in a direction in which the slide pin is separated from the pin spring 49 by the spring force of the pin spring 49. As shown in FIGS. 3 and 9, the bottom of the guide groove 46 is fitted to the guide pin 47 with the stem through hole 48 located over the stem 15*b* or 16*a*.

In the above-mentioned operational state at low speed or at a low load, since the top of the stem 15*b* or 16*a* of the intake poppet valve 13*b* or the exhaust poppet valve 14*a* can slide relatively freely through the stem through hole 48 of the slide pin 45, the intake poppet valve 13*b* or the exhaust poppet valve 14*a* is held a closed state. In other words, the exhaust poppet valve 14*a* is held in a closed state even if the valve lifter 18*a* or 18*b* with the valve pause mechanism is vertically lifted or lowered by the inlet cam 21 or the exhaust cam 22 and is set to a valve pause state.

However, when the OHC four-stroke internal combustion engine 1 is operated at high speed or at a high load and oil pressure is supplied to the oil pressure passage 51, oil pressure is supplied into the pin hole 44 from the oil pressure passage 51 via the connecting hole 54, the peripheral concave groove 53, the side hole 55 and the peripheral concave groove 56 and the slide pin 45 is driven in a direction in which the slide pin approaches the pin spring 49 against the spring force of the pin spring 49 by the pressure of pressure oil in the opening of the pin hole 44. As shown in FIGS. 4, 5 and 10, the respective stems 15*b* and 16*a* of the intake poppet valve 13*b* and the exhaust poppet valve 14*a* are fitted into each bottom cutout 45*a* of each slide pin 45. Therefore, as shown in FIG. 5, the intake poppet valve 13*b* and the exhaust poppet valve 14*a* are opened and closed.

As the valve pause mechanism 41 is respectively built in the valve lifters 18*a* and 18*b* with the valve pause mechanism, the height is apt to be large. However, as no shim 33 is provided to the valve lifters 18*a* and 18*b* with the valve pause mechanism, the height of the valve lifters 18*a* and 18*b* with the valve pause mechanism is reduced by a quantity. Even if a valve included angle of the intake poppet valve 13 and the exhaust poppet valve 14 is reduced to reduce the combustion chamber 8 and increase compression ratio, the height of the cylinder head 4 does not need to be increased, and the large-sizing of the OHC four-stroke internal combustion engine 1 is avoided.

Further, since no shim 33 is provided to the valve lifters 18*a* and 18*b* with the valve pause mechanism, the equivalent weight of the intake poppet valve 13*b* and the exhaust poppet valve 14*a* decreases, the spring load of the valve spring 31 is reduced and power loss for opening or closing the intake poppet valve 13*b* and the exhaust poppet valve 14*a* is reduced.

Furthermore, since work for attaching the shim 33 to the valve lifters 18*a* and 18*b* with the valve pause mechanism is not required, man-hours for assembly are reduced, and productivity is enhanced.

In addition, since the valve lifters 17*a* and 17*b* without the valve pause mechanism have no valve pause mechanism 41, the height of the valve lifters 17*a* and 17*b* without the valve pause mechanism can be made equal to the height of the valve lifters 18*a* and 18*b* with the valve pause mechanism, even if the shim 33 is provided. Only one type of valve guide cylinder 34 is prepared for the valve lifters 17*a* and 17*b* without the valve pause mechanism. Thus, the stock management of the valve lifters 17*a* and 17*b* without the valve pause mechanism is simplified, and the cost can be reduced.

In a state wherein the exhaust poppet valve 14*a* and the intake poppet valve 13*b* are operated at a low speed or at a low load at which the valve is paused by the valve lifters 18*a* and 18*b* with the valve pause mechanism, since the intake poppet valve 13*a* and the exhaust poppet valve 14*b*, respectively, are always opened or closed and are diagonally located as shown in FIGS. 2 and 6, a swirl is generated in an air-fuel mixture in the combustion chamber 8. Thus, ignition is securely executed, the generation of unburned gas is inhibited and the fuel economy is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder head of a four-stroke internal combustion engine, comprising:

a plurality of valve guides for respectively guiding and supporting an intake poppet valve and an exhaust poppet valve which slide in an opened or closed direction, the poppet valves having a substantially uniform thickness in the longitudinal direction of each valve guide, a depth in which at least one valve guide of the plurality of valve guides is fitted into one of a plurality of fitting holes of the cylinder head with a depth relative to depths by which the other valve guides are fitted into others of the fitting holes of the cylinder head, wherein:

an idle fitting hole is formed above one of the fitting holes which is formed deeper in the cylinder head than the other fitting holes, the idle fitting hole extending upward to a lower side of a valve spring, the idle fitting hole having an inner diameter than inner larger than outer diameters of the valve guides inserted therein.

2. The cylinder head of a four-stroke internal combustion engine according to claim 1, wherein inner lengths and diameters of all of the fitting holes are substantially equal, so that a fitting force required to set each of the valve guides is substantially equal.

3. The cylinder head of a four-stroke internal combustion engine according to claim 1, and further including biasing means for individually biasing the inlet poppet valve and the exhaust poppet valve to a closed positioned.

4. The cylinder head of a four-stroke internal combustion engine according to claim 1, wherein an inner diameter of the idle fitting hole is larger than inner diameters of the fitting holes.

5. The cylinder head of a four-stroke internal combustion engine according to claim 4, wherein the second section for accommodating the valve guide is a diameter for providing no interference with the valve guide.

6. The cylinder head of a four-stroke internal combustion engine according to claim 4, wherein the second section for accommodating the valve guide is a diameter where no buckling in a valve spring retainer occurs relative to the valve guide.

7. A cylinder head of a four-stroke internal combustion engine, comprising:

a first valve guide having a first length and press fitted into a first fitting hole having a depth ($H_2$), and a second valve guide having a second length greater than the first length and press fitted into a second fitting hole having a depth ($H_3$) substantially equal to the first depth ($H_2$), wherein only the second valve guide is located in a idle fitting hole, the idle fitting hole having a depth (H).

8. The cylinder head of a four-stroke internal combustion engine according to claim 7, wherein the idle fitting hole has a no interference fit with the second valve guide, the depth (H) of the idle fitting hole being measured from a retainer to where the second fitting hole begins.

9. The cylinder head of a four-stroke internal combustion engine according to claim 7, and further including biasing means for individually biasing the inlet poppet valve and the exhaust poppet valve to a closed positioned.

10. The cylinder head of a four-stroke internal combustion engine according to claim 7, wherein an inner diameter of the idle fitting hole is larger than inner diameters of the fitting holes.

11. The cylinder head of a four-stroke internal combustion engine according to claim 10, wherein the second section for accommodating the valve guide is a diameter for providing no interference with the valve guide.

12. The cylinder head of a four-stroke internal combustion engine according to claim 10, wherein the second section for accommodating the valve guide is a diameter where no buckling in a valve spring retainer occurs relative to the valve guide.

13. A cylinder head of an internal combustion engine comprising:

at least one intake poppet valve;

at lease one exhaust poppet valve;

a first valve guide for guiding and supporting the intake poppet valve for sliding in an opened or closed direction;

a second valve guide for guiding and supporting the exhaust poppet valve for sliding in an opened or closed direction;

said first valve guide having a substantially uniform thickness in the longitudinal direction and a first predetermined depth;

said second valve guide having a substantially uniform thickness in the longitudinal direction and a second predetermined depth;

a first fitting hole formed in said cylinder head and having a depth corresponding to the first predetermined depth;

a second fitting hole formed in said cylinder head and having a depth corresponding to the second predetermined depth; and an idle fitting hole having a depth determined by subtracting a depth substantially equal to the first predetermined depth of the first fitting hole from a depth of the second fitting hole, the idle fitting hole being positioned above said second fitting hole.

14. The cylinder head for an internal combustion engine according to claim 13, and further including biasing means for individually biasing the inlet poppet valve and the exhaust poppet valve to a closed positioned.

15. The cylinder head for an internal combustion engine according to claim 13, wherein the second fitting hole includes a first section that is substantially equal in depth to the depth of insertion of the first valve guide in the first fitting hole and a second section that accommodates the second valve guide with a diameter that is substantially equal to the diameter of the second valve guide.

16. The cylinder head for an internal combustion engine according to claim 15, wherein the second section for accommodating the second valve guide is a diameter for providing no interference with the second valve guide.

17. The cylinder head for an internal combustion engine according to claim 15, wherein the second section for accommodating the second valve guide is a diameter where no buckling in a valve spring retainer occurs relative to the second valve guide.

18. A cylinder head of an internal combustion engine comprising:

at least one intake poppet valve;

at lease one exhaust poppet valve;

a first valve guide for guiding and supporting the intake poppet valve for sliding in an opened or closed direction;

a second valve guide for guiding and supporting the exhaust poppet valve for sliding in an opened or closed direction;

said first valve guide having a substantially uniform thickness in the longitudinal direction and a first predetermined depth;

said second valve guide having a substantially uniform thickness in the longitudinal direction and a second predetermined depth;

a second fitting hole formed in said cylinder head and having a depth corresponding to the second predetermined depth; and a first fitting hole formed in said cylinder head and having a depth determined by subtracting a depth substantially equal to the second predetermined depth of the second fitting hole from a depth of the first fitting hole with the first valve guide being positioned within said first fitting hole with a depth of fitting substantially equal to a depth of fitting of the second valve guide positioned within the second fitting hole.

19. The cylinder head for an internal combustion engine according to claim 18, wherein the first fitting hole includes a first section that is substantially equal in depth to the depth of insertion of the second valve guide in the second fitting hole and a second section that accommodates the first valve guide with a diameter that is substantially equal to the diameter of the first valve guide.

20. The cylinder head for an internal combustion engine according to claim 19, wherein the second section for accommodating the first valve guide is a diameter for providing no interference with the first valve guide.

21. The cylinder head for an internal combustion engine according to claim 18, and further including biasing means for individually biasing the inlet poppet valve and the exhaust poppet valve to a closed positioned.

22. The cylinder head for an internal combustion engine according to claim 18, wherein the second section for accommodating the first valve guide is a diameter where no buckling in a valve spring retainer occurs relative to the first valve guide.

* * * * *